US005113738A

United States Patent [19]

Krucoff

[11] Patent Number: 5,113,738

[45] Date of Patent: May 19, 1992

[54] RECORDED MUSIC ENHANCEMENT SYSTEM

[76] Inventor: Darwin Krucoff, 2820-B Alta View Dr., San Diego, Calif. 92139

[21] Appl. No.: 198,249

[22] Filed: May 25, 1988

[51] Int. Cl.[5] ..... A63J 17/00; G10G 3/04

[52] U.S. Cl. ..... 84/462; 84/464 R; 84/DIG. 12; 360/27; 360/79

[58] Field of Search ..... 84/1.28, 462, 464 R, 84/464 A, DIG. 18, DIG. 29, 601-604, 611, 612, 635, 636, 639-643, DIG. 12; 360/27, 79

[56] References Cited

U.S. PATENT DOCUMENTS

| | | | |
|---|---|---|---|
| Re. 32,341 | 1/1987 | Smith | 84/464 R |
| 3,781,452 | 12/1973 | Vauclain | 84/1.28 |
| 4,256,008 | 3/1981 | Ryon | 84/DIG. 18 |
| 4,256,009 | 3/1981 | Verduin et al. | 84/464 R |
| 4,339,980 | 7/1982 | Hooke et al. | 84/1.28 |
| 4,376,404 | 3/1983 | Haddad | 84/464 R |
| 4,417,497 | 11/1983 | Nicklaus | 84/485 R |
| 4,546,687 | 10/1985 | Minami | 84/1.28 |

OTHER PUBLICATIONS

Ex parte S (Board of Appeals) Aug. 4, 1943 (Case No. 109), 25 *Journal of the Patent Office Society* 904.

*Primary Examiner*—Stanley J. Witkowski
*Attorney, Agent, or Firm*—Charles C. Logan, II

[57] ABSTRACT

A recorded music enhancement system (RMES) utilizing a recording media such as audio tape or compact disc with a separate track for a control waveform or digital code which controls secondary stimuli, such as pulsing lights, so that they pulse in time with the music, or are otherwise coordinated with the music in some artistic arrangement. This system has a triac to switch the power on and off to the lights or other secondary stimuli, and includes a tone or digital code detector which receives the input waveform from the extra track on the recording medium and operates the triac as a function of the input waveform, in essence causing lights or other stimuli to reproduce the rhythm variations of the music as it is played from the tape or other recording medium.

8 Claims, 2 Drawing Sheets

RECORDED MUSIC ENHANCEMENT SYSTEM

BACKGROUND OF THE INVENTION

The invention is in the field of providing secondary stimuli with music. A great deal of current popular music has a strong beat or rhythm and is usually played at a loud level due to the considerable interest in this aspect of the music. The invention adds an additional dimension to the pleasure of this music by displaying the rhythm in visual form so that it can be seen as well as heard. All variations, or patterns, of the rhythm are readily programmed and synchronized to the music. Multiple displays can be incorporated, light levels can be varied, and even a sense of touch can be provided.

A further object of the invention is to make recorded music more enjoyable for the hearing impaired, from those with less impairment to whom the rhythm portion of the music would be particularly important, to those with greater impairment who would mainly, or entirely enjoy the visual display.

Another group who would benefit and find pleasure in this invention are those exercising in an aerobiics program, either in a studio or at home. The visual display of the rhythms would aid their timing and make the exercise more enjoyable.

Discotheques are another area where the invention is needed. Although they use a wide variety of lighting effects, there is little synchronization with the music. Application of the invention would considerably expand the versatility and caliber of the light shows.

SUMMARY OF THE INVENTION

The instant invention can be used with all forms of recorded music to drive one or more secondary stimuli precisely in accordance with the rhythm of the music, in all of its forms. Such stimuli may be one or more sets of lights mounted on the player, and/or connected for external use, or devices to provide a tactile sense of the rhythm. Central to the concept is the recording of the rhythm variations on a separate track of the recording medium, which can be called the rhythm track. By utilizing a separate track for these signals, unwanted interference by and with the music is avoided and every nuance of the rhythm can be easily captured and reproduced. Perfect synchronization between the rhythm signals and the music is maintained during playback by recording both on the same medium, tape or disc.

For analog recording the rhythm signal can consist of bursts of a fixed frequency audio tone, with the durations of the bursts and the spacings between the bursts corresponding to the desired variations of the rhythm of the adjacently recorded music. For digitally recorded music, as on compact discs or digital audio tape, the rhythm signal can be a digital code. Multiple audio tones, or digital codes, can be used to control either multiple output units, or the intensity of the output of a single unit, with all the signals recorded on the rhythm track.

Recording of the rhythm signals is performed by a musican either during the original recording or by subsequent dubbing. This is done by operating a switch, just as a musical instrument, to place the rhythm signal on the tape or disc at the desired times and for the desired durations.

For playback in the analog case, a tone detector, DC power source, and a triac are all that are required, with additional detectors and triacs if multiple rhythm signal frequencies are used. In the digital case the tone detectors are replaced by code detectors. For output intensity variation, power controllers such as phase controlled triacs are substituted for the triacs.

DESCRIPTION OF THE PREFERRED EMBODIMENT

Figure 1:
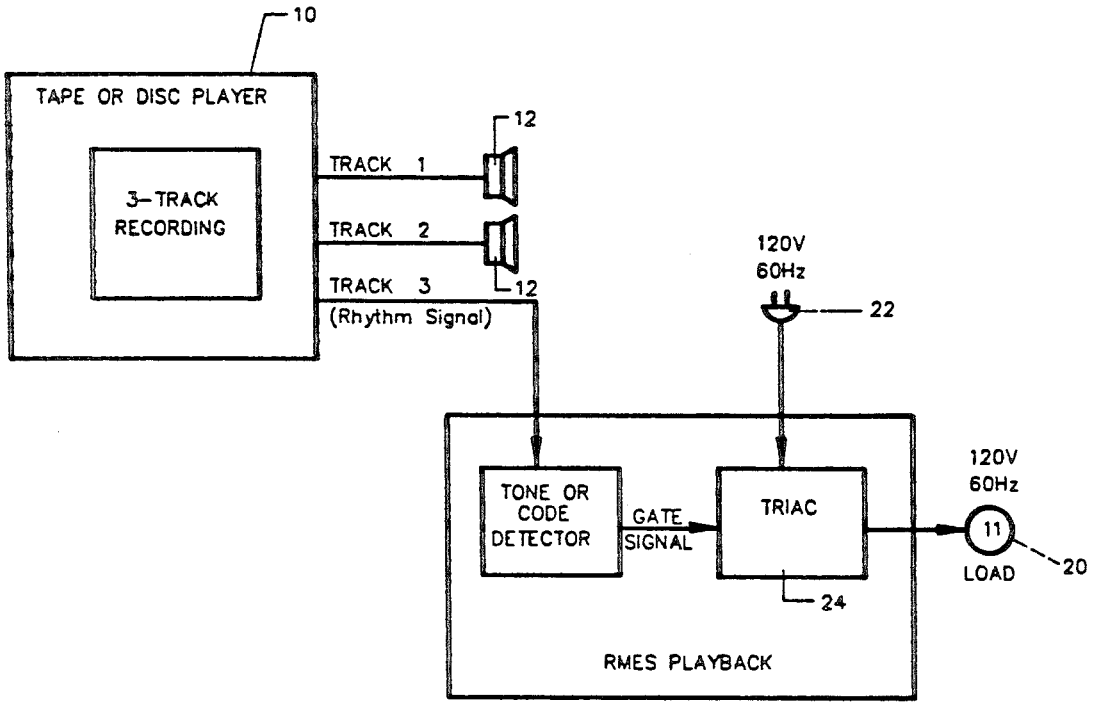
FIG. 1 is a block diagram of the system.

As shown in FIG. 1, the invention comprises a music reproduction system such as the tape or disc player indicated at 10. The player has two tracks which drive the two speakers 12 and the third track contains the rhythm signal waveform or digital code which controls the secondary stimuli. Using a 3-track system permits the use of stereo music and could be accomplished with the use of 3-track tape recording and playback heads. Initially the conventional 2-track stereo system could be used with monaural music on one track and the rhythm signal on the other. The difference between stereo and monaural music may not be very important to listeners primarily interested in the rhythm and for certain applications such as during aerobic exercises. Also, the digital system could be used, instead of the analog tone technique, with the multi-track compact disc. The digital system is substantially the same as the analog system with the audio tone or tones of the analog system replaced by digital codes and the tone detector replaced by a code detector. The rythm signal 14 from track 3 is applied to a tone or code detector 30 which furnishes a gate signal to triac 24 to turn on the load 20.

Figure 2:
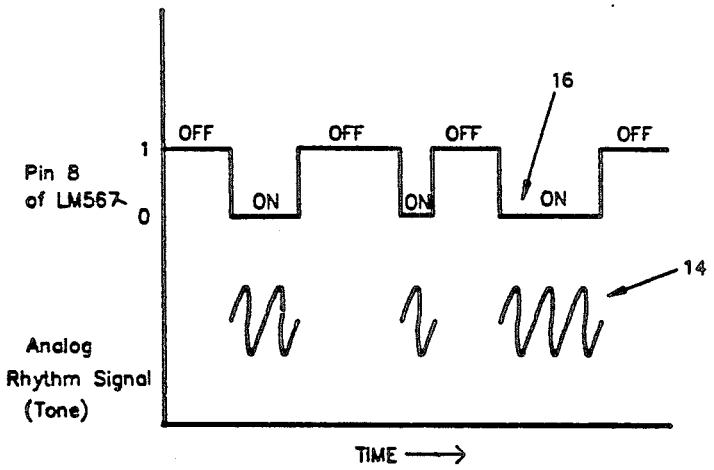
FIG. 2 is a waveform diagram of the triggering tone and the responding digital output signal from the tone detector for the analog case.

FIG. 2 shows the analog rhythm signal from the third track as bursts of an audio frequency waveform of constant amplitude and frequency which is input to the tone detector. For clarity this waveform is shown at a lower frequency than would be used. The tone detector 30 produces a gate signal when a tone of sufficient magnitude and of the proper frequency is present at the input as indicated in this waveform drawing. The drawing also shows a digital code used in an analogous fashion with a code detector. In the drawing the input signal 14 actuates the digital output gate signal 16, and rhythm variations are recorded by varying the duration and spacing of 14. When the digital output of the tone detector goes low, as indicated in FIG. 2, the triac is turned on and any lights or other secondary stimulus, indicated at 20 in FIG. 1 as generic "load", is turned on. An example of another type of secondary stimulus is a tactile stimulator which could be an electromechanical pulser or vibrator hand held or otherwise used to provide a direct feel of the rhythm while listening to the music. The system operates from house current as indicated by plug 22 and contains an internal power supply to operate the tone detector and triac.

Figure 3:
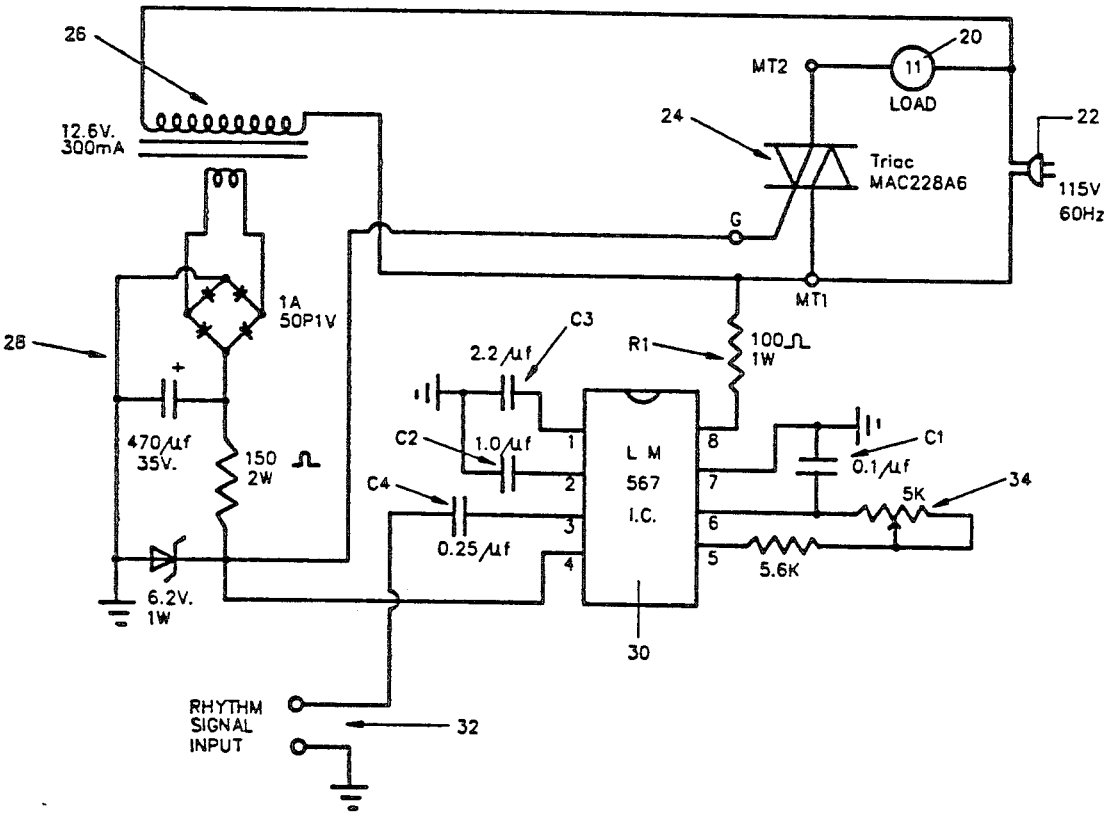
FIG. 3 is a schematic diagram of the analog playback.

Turning now to FIG. 3, the triac is indicated at 24, and it is clear from that drawing that when the triac is on, the load 20 is driven from the house current 22. The house current also drives a transformer 26 which produces about 12.6 volts in the secondary coil, which is rectified by the bridge rectifier circuit 28 to produce a steady DC of about 6 volts. The positive side of this DC is provided to the integrated circuit tone detector 30 at pin 4 and to the triac 24 at its gate terminal G. This power supply is shown for completeness and to indicate a need for DC power of about 6 volts and 75 milliamperes or less, depending upon the power capacity of the triac selected. In practice the DC power would be obtained from the power supply of the music system.

The tone detector used in the invention is a phase-locked loop unit, specifically, the LM 567. The circuit features an adjustable bandwidth from 0 to 14 percent and a high rejection of out of band signals and noise. It also contains a saturated transistor switch to ground when an input signal is present within the passband. The signal is input at 32 through a DC-isolating capacitor C4. The LM 567 IC is made to be wired with external circuitry as shown. The resistance between pins 5 and 6 and the capacitance between pins 6 and 7, C1, determines what frequency the LM 567 will detect. As indicated above, it is highly selective. In the instant application, a potentiometer 34 has been incorporated into the resistance so that the unit can be tuned specifically to the frequency of a particular input.

A low pass capacitor C2, connected between pin 2 and ground, is used to establish the bandwidth around the primary input frequency. The bandwidth is controlled by the product of the principal frequency, which is largely selected by adjusting the potentiometer 34, and the capacitance of capacitor C2. Generally the band width is about 10 percent of the primary frequency.

Capacitor C3 is an output filter capacitor whose value is noncritical. This capacitor attenuates frequencies outside the detection band to eliminate spurious outputs, and is generally selected to be at least twice the capacitance of capacitor C2.

Output pin 8 drops from a logic 1 to a logic 0, as shown in the waveform in FIG. 2, when the rhythm signal is input at 32, and provides a 100 milliampere current sinking capability. This causes DC current, limited by resistor R1, to pass through the triac from the gate terminal G to one of the main terminals MT1, which turns it on and energizes the load 20. When the rhythm signal is interrupted, pin 8 returns to a logic 1 and the triac reverts to its off state. Thus the load 20 follows the pattern and the duration of each of the recorded rhythm signals.

As indicated, the invention can be expanded well beyond its present form to operate different lights, tactile stimuli, and anything else, and not merely as a note reproduction of the beat, but as an orchestration by one who creates the tape or disc to create any pattern of interacting stimuli, following along with the principal stimulus, which of course is the music.

What is claimed is:

1. In a recorded music apparatus having at least one track of a recording medium recorded with music, a recorded music enhancement system for driving at least one secondary stimulus from an additional track on said recording medium, said recorded music enhancement system comprising:

(a) a waveform recorded on said additional track of substantially uniform frequency and having bursts whose time durations and spacing between bursts corespond with the desired rhythm variations of the music recorded on said at least one track of the recording medium, with the waveform signals recorded simultaneously with the recording of the music or subsequently to it;

(b) a tone detector inputting said wave form and responding to the waveform by outputting a digital gate signal corresponding to the presence of said waveform during said time durations;

(c) a switch operatively connected to said tone detector to switch between on and off modes responsive to said digital gate signal; and (d) at least one secondary stimulus controlled by said switch to cause said secondary stimulus to be driven in coordination with said waveform and thus in coordination with music on said at least one track.

2. A recorded music enhancement system as recited in claim 1 wherein said tone detector discriminates against all but a selected frequency, and defines means for tuning said frequency and establishing a band width around the tuned frequency.

3. A recorded music enhancement system as recited in claim 1 wherein said tone detector comprises a phase-locked loop integrated circuit and its external control circuit.

4. A recorded music enhancement system as recited in claim 1 wherein said switch is a triac.

5. A recorded music enhancement system as recited in claim 1 wherein said external stimulus is one or more lights.

6. A recorded music enhancement system as recited in claim 1 wherein said external stimulus is one or more tactile stimulators.

7. A recorded music enhancement system as recited in claim 1 wherein multiple frequencies are used with corresponing multiple tone detectors to operate multiple secondary stimuli or to operate one or more stimuli at one or more different power levels.

8. A system as recited in claim 1 wherein the recorded music apparatus is a three track system of which two tracks are used to record stereo music and the third track is used to record the waveform signals.

* * * * *